United States Patent [19]

Baitz et al.

[11] Patent Number: 4,638,908

[45] Date of Patent: Jan. 27, 1987

[54] INSERT FOR A MONEY DRAWER

[75] Inventors: Guenter Baitz; Wilfried Dobring, both of Berlin, Fed. Rep. of Germany

[73] Assignee: Nixdorf Computer AG, Fed. Rep. of Germany

[21] Appl. No.: 717,374

[22] Filed: Mar. 29, 1985

[30] Foreign Application Priority Data

Mar. 29, 1984 [DE] Fed. Rep. of Germany ... 8409722[U]

[51] Int. Cl.[4] ..... A45C 11/28

[52] U.S. Cl. ..... 206/0.8; 206/0.84; 206/557; 206/560; 220/22; 220/23.83; 235/22

[58] Field of Search ..... 206/0.8, 0.84, 557, 206/560, 561, 509, 512; 220/22, 22.1, 22.2, 22.3, 409, 410, 23.83, 23.86; 235/22

[56] References Cited

U.S. PATENT DOCUMENTS

| | | | |
|---|---|---|---|
| 495,934 | 4/1893 | Foote | 206/0.84 |
| 1,389,986 | 9/1921 | Ristenpart | 206/561 |
| 1,677,544 | 7/1928 | Brainard et al. | 220/22.3 |
| 1,840,485 | 1/1932 | Butler | 220/22 |
| 2,257,536 | 9/1941 | Roycroff | 220/22 |
| 2,597,365 | 5/1952 | Newman | 206/0.84 |
| 2,681,730 | 6/1954 | Carne | 235/22 |
| 2,985,333 | 5/1961 | Kirkman | 220/22.3 |
| 3,321,262 | 5/1967 | Mogler | 235/22 |
| 3,499,540 | 3/1970 | Huncovsky | 220/22 |
| 3,708,709 | 1/1973 | Morrison et al. | 206/561 |
| 3,892,309 | 7/1975 | Coffey et al. | 235/22 |
| 4,024,590 | 5/1977 | Wendt | 220/23.83 |
| 4,176,747 | 12/1979 | Aho | 206/509 |
| 4,412,709 | 11/1983 | Ishii | 235/22 |
| 4,436,989 | 3/1984 | Schuldt | 235/22 |

FOREIGN PATENT DOCUMENTS

| | | | |
|---|---|---|---|
| 8310732 | 7/1983 | Fed. Rep. of Germany . | |
| 903089 | 8/1962 | United Kingdom | 220/22.3 |

*Primary Examiner*—Joseph Man-Fu Moy
*Assistant Examiner*—David T. Fidei
*Attorney, Agent, or Firm*—Krass & Young

[57] ABSTRACT

An insert for a money drawer for receiving coins, currency, bills and the like including a relatively large area lower tray defining a plurality of relatively long and relatively deep compartments running from front to rear of the lower tray and sized to accommodate paper currency, a relatively small area upper tray defining a plurality of relatively short and relatively shallow compartments running from front to rear of the upper tray and sized to receive metal currency, and coacting means on the lower tray and on the upper tray for removably mounting the upper tray in the upper rear region of the lower tray so that the upper tray overlies the rear portions of the relatively long currency compartments defined by the lower tray. The walls defining the compartments in the lower tray are removably positioned in the lower tray and are shaped to conform to the outline of the lower side of the upper tray, and a guide rail is provided on the front edge of the upper tray for slidably supporting one or more holddown devices which extend into the front region of the lower tray to engage the currency in the lower tray. An auxiliary region of the lower tray, laterally outside of the region of the upper tray, has a reduced depth and is provided with a plurality of pivotally mounted transverse walls to define a plurality of laterally extending compartments.

6 Claims, 4 Drawing Figures

INSERT FOR A MONEY DRAWER

Field of the Invention

The innovation relates to an insert for a money drawer for receiving coins, currency bills and the like, in the form of a trough-like receptacle open at the top.

BACKGROUND OF THE INVENTION

Such an insert for a money drawer is already known from German Utility Pat. No. G 83 10 732. This insert can be divided by insertable lengthwise or transverse partial walls into a plurality of compartments and thus offers the capability of arranging coins or bills or other currency by their differing values or sizes. The division into different compartments can be varied, so that their size can be changed. For this the lengthwise partial walls can be inserted between the transverse partial walls with various mutual spacings. The insert may be removed as a whole from the money drawer of a cash register for example, in order, for example, to put the supply of cash on hand under lock and key at another place at the end of a business day. The known insert shows relatively large surface dimensions for a given useful surface area. For carrying the insert including cash on hand away, it would be desirable for the insert to have only comparatively small surface dimensions. Also it would be desirable for the insert to have only a relatively small base areas for storing the insert in a night safe for example. Moreover, for ergonomic reasons the operating of cash registers requires that the drawers have very short opening paths. Short opening paths are achieved in this case for a given useful surface area of the money drawer, and thus of the cash insert, by comparatively wide money drawers or money inserts of small depth. For broad drawers with a small depth, however, there is generally a problem that they tilt slightly when opening and thus do not ensure a trouble-free and easy operation. Accordingly, a cash insert is desirable which shows smaller surface dimensions than those of the state of the art and in which the available useful surface area is not substantially limited.

Therefore it is the object of the present invention to supply an insert for a money drawer which, for the same given useful surface area and width, nevertheless shows a considerably reduced depth as compared with the state of the art.

SUMMARY OF THE INVENTION

With this innovation an insert for a money drawer is available which, for a given useful surface area, has a distinctly reduced width and/or depth as compared with the state of the art.

Since an upper tray is inserted in the upper rear region of a lower tray with an insert of this type, two separate receiving spaces exist one over another. If, for example, the currency bills are laid in the lower tray and the coins in the upper tray, this ensures an exact separation of paper money and coins. Also, the paper money is accommodated better protected than in the state of the art so that it is more difficult for a thief to remove bills from the opened cash drawer.

It is advantageous for the insert to be developed further by having the lower tray and/or the upper tray divided by separating walls standing parallel to the sliding direction of the money drawer and insertable in insertion openings, preferably grooves. In this way the division into compartments of the lower tray and/or the upper tray can be varied by simply reinserting individual separating walls so that a plurality of different compartment sizes can be achieved.

The transverse partial walls of the receptacle can also be at least partially constructed like the lengthwise partial walls. It is advantageous for the transverse partial walls to be pivoted with pivots at the upper edge of the side walls of the receptacle and to be caught in its bottom party by means of anchoring catches through a swinging motion.

In a preferred embodiment, at least one holding-down device is supported on the upper tray in the front region of the lower tray. Since bills, because of their use, usually do not lie flat on one another, the space taken up by these can be reduced distinctly by a holding-down device. Besides this, the bills are held fast so that they are better protected against the action of wind. Since the upper tray is inserted in the upper rear region of the lower tray, and the bills thus lie open and unprotected only in the front region of the lower tray, a holding-down device need be mounted only in the front region of the lower tray. For construction reasons it is advantageous to mount this on the upper tray.

It is advantageous to provide on the upper tray a guide rail for the movable support of the respective holding-down device. In this way the respective holding-down device can be mounted at the point prescribed for it corresponding to the division of the compartments.

If the guide rail is arranged spaced apart from the side wall of the upper or lower tray at at least one end, then the number of holding-down devices on the guide rail can be varied. The holding-down devices are simply pushed within the receptacle to the free end of the guide rail and brought to the point prescribed for them.

It is advantageous to provide a further guide rail for a further holding-down device on the rear wall of the lower tray in the region of the segment with reduced depth. In this way this region of the lower tray, if necessary, can be used as an additional bill compartment after the mounting of a holding-down device.

An embodiment example of an insert for a money drawer according to the invention is described in the following on the basis of the figures.

DETAILED DESCRIPTION OF THE PREFERRED EMBODIMENT

Figure 1:
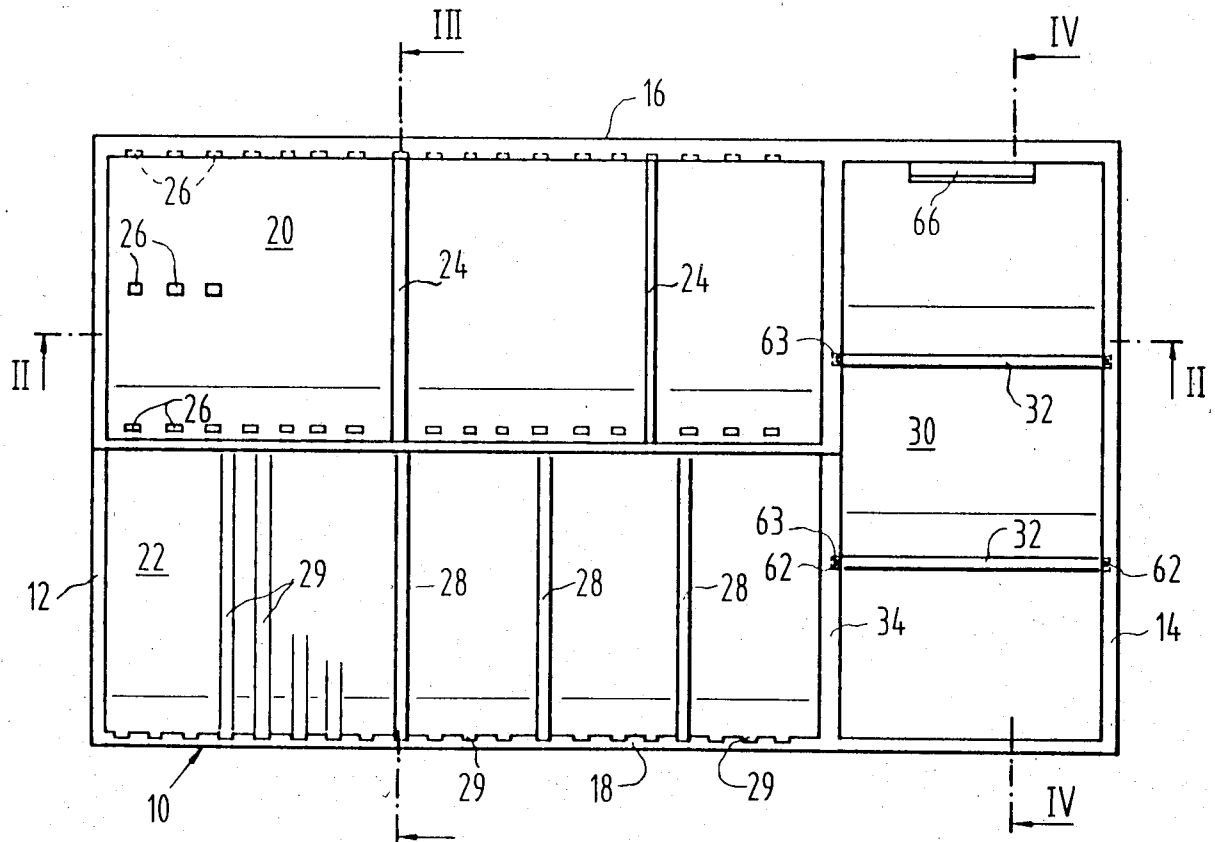
FIG. 1 shows a top plan view of the drawer insert.
Figure 3:
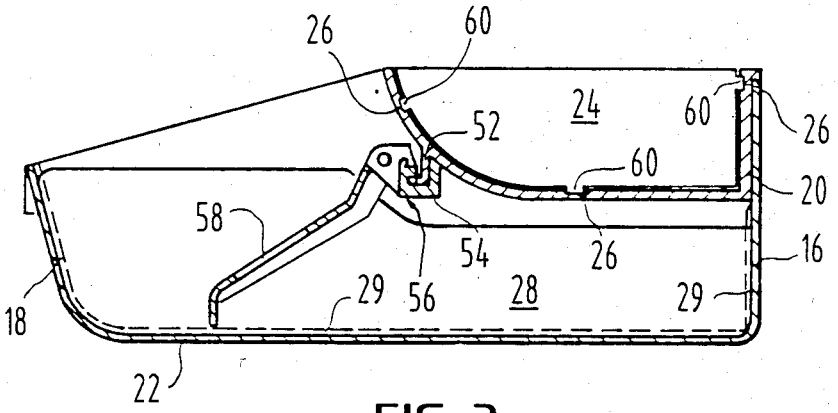
FIG. 3 shows the section III—III according to FIG. 1.

In FIG. 1 is represented in a top plan view a rectangular drawer insert 10 which has vertical side walls 12,14, a vertical rear wall 16 and a front wall 18. As FIG. 3 shows, the front wall 18 runs obliquely downward, so that a trough shape results from this which is known in itself for drawer inserts of this type. Moreover, an upper tray 20 can be seen which is inserted in the upper rear region of a lower tray 22. The upper tray 20 is divided by lengthwise partial walls 24 standing parallel to the sliding direction of the money drawer. These lengthwise partial walls 24 can be inserted into receivers 26 or removed from these. In this manner the distribution or the size of the money compartments can be varied. The lower tray 22 like the upper tray 20 is divided by separating walls 28 standing parallel to the sliding direction of the money drawer. These can be inserted from above in grooves 29 which run from the upper edge of the front wall 18 over the bottom up to about half the height of the rear wall 16 (see also FIG. 3). Here too the distribution and also the compartment size can be varied.

Figure 2:
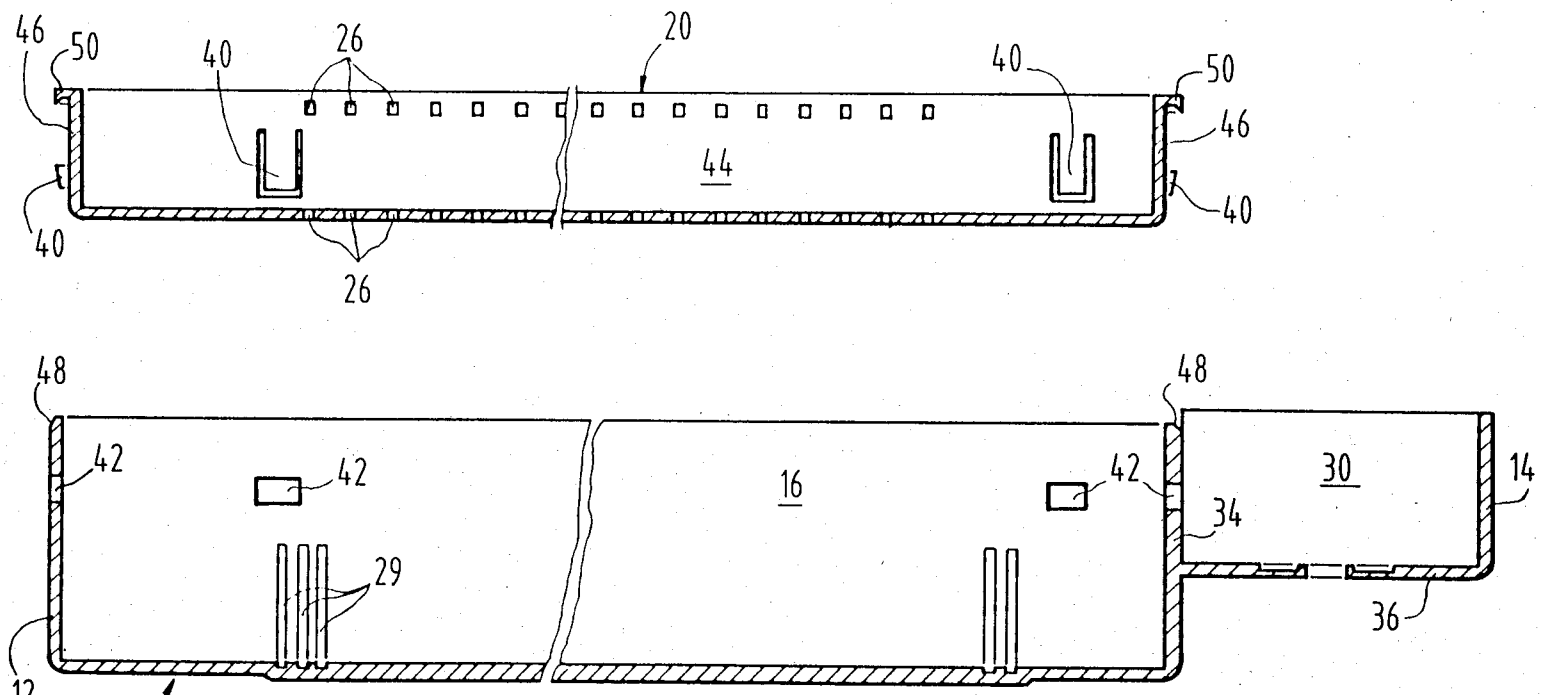
FIG. 2 shows the section II—II according to FIG. 1 in a spread-apart representation.
Figure 4:
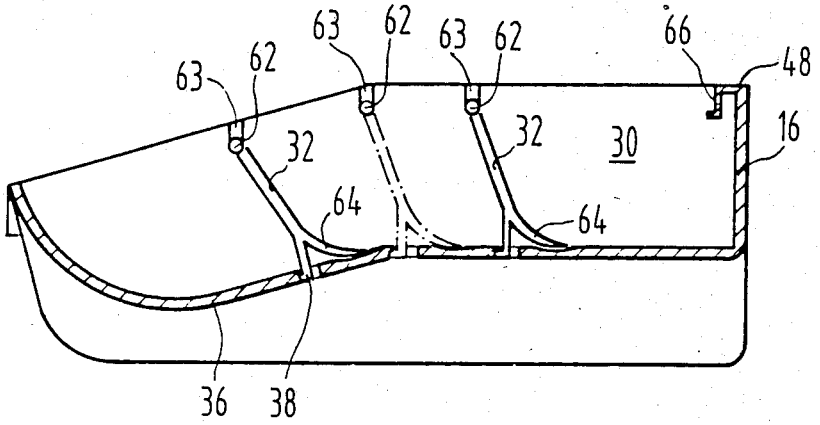
FIG. 4 shows the section IV—IV according to FIG. 1.

Outside the region of the upper tray 20, the lower tray 22 has a segment with a depth decreased starting from the receptacle's upper edge 48 (FIG. 2); this is to be seen in FIG. 2. This segment 30 of the lower tray is provided with transverse partial walls 32. These transverse partial walls 32 are pivoted with pivots 62 on the upper edge of the two walls 14 and 34 of the receptacle segment 30 of the lower tray 22 and can be caught in the bottom part 36 of the latter by means of anchoring tongues 38 (FIG. 4).

FIG. 2 shows the section II—II from FIG. 1 in a spread-apart representation. It is seen from the figure that the upper tray 20 can be placed in the lower tray 22. The upper tray 20 and the lower tray 22 then together form two separate receiving spaces. In assembling these the upper tray 20 is caught in the lower tray 22. For this, on the one hand catching studs 40 are provided on the rear wall 44 and on the side walls 46 of the upper tray 20, and on the other hand recesses 42 are arranged in the rear wall 16 or in the walls 12 and 34 of the lower tray 22, in such a way that the upper tray 20, when placed in the lower tray 22, catches with its catching studs 40 in these recesses 42. Moreover, in the upper tray 20 are to be seen the receivers 26 in which the lengthwise partial walls 24 are inserted. At 29 only a few grooves 29 of the lower tray 22 are depicted in which the separating walls 28 (FIG. 1) are inserted. Outside of the region of the upper tray 20, the lower tray 22 has the segment 30 with a reduced depth starting from the upper edge 48 of the receptacle.

The upper edge 50 of the receptacle of the upper tray is formed on the rear wall 44 of the latter and on both side walls 46 as a laterally overlapping flange which overlaps the upper edge 48 of the receptacle of the lower tray 22 at the points of support. Thus, together with the recesses 42 and the cathing studs 40 catching in these, a firm retaining of the upper tray 20 in the lower tray 22 is ensured.

FIG. 3 shows the section III—III in FIG. 1. The lower tray 22 and the upper tray 20 inserted in this are to be seen. On the front part of the upper tray 20 is formed an L-shaped guide rail 52. The retaining part 54 of a holding-down device 56 is movably supported on this guide rail 52. The retaining part 54 has a hollow section complementary to the L shape of the guide rail 52, which section grasps the guide rail 52 in a substantially form-locking manner, so that the holding-down device 56 can be pushed transversely to the sliding direction of the money drawer. In this way the position of a respective holding-down device 56 can be adapted to the chosen compartment distribution of the lower tray. The guide rail 52 is arranged spaced apart from the side wall of the upper or lower tray at at least one of its ends. In this way, even when the upper tray 20 is inserted, the number of holding-down devices 56 can be varied, since either holding-down devices 56 can be removed or else, when necessary, additional ones can be put on. A holding-down arm 58 can be swung upward on the retaining part 54. When it is swung upward, the holding-down arm 58, after crossing a dead-center position, is pulled into an upper removal position. This makes possible a one-handed operation of the holding-down devices 56. At 29 is seen one of the grooves 29 which runs from the upper edge of the front wall 18 over the bottom to about half the height of the rear wall 16. A separating wall 28 is inserted into this from above. The shape of this separating wall 28 is adapted to the outline of the upper tray 204. A lengthwise partial wall of the upper tray 20 is represented by 24. This lengthwise partial wall 24 is catchable with pins 60 in the recesses 26. By means of these lengthwise partial walls 24, just as with the separating walls 28 of the lower tray, the distribution and the size of the individual compartments can be varied.

Obviously it is also possible to support the lengthwise partial walls 24 of the upper tray 20 in grooves or to catch the lengthwise partial walls 28 of the lower tray 22 with pins in recesses. The latter has the advantage that the lengthwise partial walls 28 (elastically deformable, in themselves) by bending can be flipped out of the recesses and moved without the upper tray 20 first being removed.

FIG. 4 shows the section IV—IV according to FIG. 1. This sectional representation shows the segment 30 lying outside the region of the upper tray 20 which segment shows a reduced depth starting from the upper edge 48 of the receptacle. The bottom 36 of the lower tray 22 is built rising in the inward moving direction of the money drawer, the transverse partial walls 32 are pivoted on the upper edge of the side walls 14 and 34 (FIG. 2) of the segment 30 of the lower tray 22 with the pivot pions 62 in receiving grooves 63 and can catch in its bottom part 36 by means of anchoring tongues 38 through a swinging motion in a clockwise direction. It may be seen that the transverse partial walls 32 are provided on their rear side with an additional curved flexible wall part 64 through which the compartments in going from the bottom 36 to the transverse partial wall 32 acquire a curved shape similar to the shape formed by the front wall 18 (FIG. 3). This additional wall part 64 can be built as a thin-walled flexible surface which, when the transverse partial wall 32 is caught in the bottom 36, can be forced against the latter. It is advantageous for the bottom 36 of the segment 30 of the lower tray 22 to be recessed at the contact points of these additional wall parts 64 in accordance with their thickness.

A further guide rail 66 is placed on the rear wall 16 near the upper edge 48 of the receptacle in the region of the segment 30. This rail ends at a distance from at least one of the side walls 14,34 such that another holding-down device 56 can be slipped on. Thus, after the removal of one or more transverse partial walls 32, another compartment can be set up in the region 30.

We claim:

1. A combination drawer and insert for receiving coins, currency, bills and the like, in the form of a trough-like receptacle open at the top, characterized by a relatively large area, relatively deep lower tray having partitions defining a plurality of relatively long compartments running from front to rear of said lower tray and sized to accommodate paper currency, a relatively small area, relatively shallow upper tray defining a plurality of relatively short compartments running from front to rear of said upper tray and sized to receive metal currency, and coacting means on said lower tray and on said upper tray for removably mounting said upper tray in the upper rear region of said lower tray so that said upper tray overlies the rear portions of said relatively long currency compartments defined by said lower tray and exposes the front portions of these compartments;

the front edge of the upper tray, when mounted in said lower tray, being rearwardly spaced from the front edge of the lower tray;

and at least one bill hold-down device mounted on the front edge of the upper tray and having a pivotal hold-down arm extending into a compartment of said lower tray.

2. An insert as claimed in claim 1 characterized in that the compartments in one of the lower tray (22) or the upper tray (20) are defined by separating walls (24, 28) which extend parallel to the sliding direction of the money drawer and are removably inserted into insertion openings (26, 19), and in that the shape of the separating walls (28) defining the compartments of the lower tray (22) are conformed to the outline of the lower side of the upper tray (20).

3. An insert as claimed in claim 1, characterized in that the lower tray (22) further includes a side compartment disposed laterally of said long compartments and laterally of said upper tray, transverse partial walls (32) arranged within said side compartment and extending transversely to the sliding direction of the money drawer.

4. An insert as claimed in claim 3, further comprising pivot means (62) on the lower tray (22), and further including anchoring tongues (38) arranged to catch in the bottom of the side compartment (30).

5. An insert as claimed in claim 1, wherein the depth of the side compartment is less than the depth of the lower tray.

6. Apparatus as defined in claim 1 further including mounting means connecting said bill hold-down device to the front edge of said upper tray and permitting said bill hold-down device to slide laterally relative to said upper tray.

* * * * *